United States Patent [19]

Volk

[11] Patent Number: 4,579,214

[45] Date of Patent: Apr. 1, 1986

[54] COIN VAULT FOR A CAR WASH OR THE LIKE

[76] Inventor: Russell D. Volk, 147 W. Dakota, Denver, Colo. 80223

[21] Appl. No.: 579,684

[22] Filed: Feb. 13, 1984

[51] Int. Cl.[4] ..... G07F 9/06

[52] U.S. Cl. ..... 194/350; 109/51; 232/15

[58] Field of Search ..... 194/1 A, 1 B; 232/15, 232/16, 43.2; 109/50, 51, 52

[56] References Cited

U.S. PATENT DOCUMENTS

| | | | |
|---|---|---|---|
| 253,129 | 1/1882 | Teese | 109/51 |
| 3,325,090 | 6/1967 | O'Brien | 232/15 X |
| 4,043,279 | 8/1977 | Padgett | 109/50 |
| 4,370,873 | 2/1983 | Edmunds | 194/1 A X |
| 4,493,268 | 1/1985 | Sidler | 109/52 |

FOREIGN PATENT DOCUMENTS

| | | | |
|---|---|---|---|
| 1168789 | 10/1969 | United Kingdom | 194/1 B |

*Primary Examiner*—F. J. Bartuska
*Attorney, Agent, or Firm*—Edwin H. Crabtree

[57] ABSTRACT

A coin vault for preventing the theft of coins used with a standard car wash coin and switch box. The vault characterized by anti-theft features which greatly reduce if not eliminate the theft of coins from a coin box. The vault can also be used equally well with any other coin operated devices used for receiving coins.

5 Claims, 4 Drawing Figures

COIN VAULT FOR A CAR WASH OR THE LIKE

BACKGROUND OF THE INVENTION

This invention relates generally to a coin vault for receiving and storing coins therein and more particularly but not by way of limitation to a coin vault used in conjunction with a standard car wash coin and switch box or any similar types of coin operated devices.

Heretofore, there have been various types of coin receiving devices used with car washes, coin collections devices and other types of coin collection systems. The prior art coin devices are described in U.S. Pat. No. 2,015,411 to Riley, U.S. Pat. No. 2,612,975 to Gallagher et al, U.S. Pat. No. 2,783,937 to Hudson, U.S. Pat. No. 3,871,284 to Krise, U.S. Pat. No. 3,979,054 to Graham and U.S. Pat. No. 4,037,700 to Heraty.

None of the above mentioned patents specifically disclose nor do they teach the unique features and advantages of the subject coin vault as described herein.

SUMMARY OF THE INVENTION

The coin vault is designed to greatly reduce if not eliminate coin theft when used in conjunction with coin operated devices.

The vault is adapted for receiving coins by gravity feed when attached to the bottom of a car wash coin and switch box and the like.

The invention is simple in design and constructed using ½ inch steel to prevent entrance by compressive force such as hammer blows and tension force such as pulling the door apart by a chain, tire iron, pry bar and the like.

The vault is streamlined in looks and gives little or no outwardly appearance as to a means for gaining entrance therein.

The moving parts of the vault are inside the top of the vault and adjacent a normally heated car wash coin and switch box to reduce the chance of freezing in the winter should moisture gather in the vault.

The coin vault is adapted for receiving coins from a coin operated device and includes an enclosed housing having an open front, a key hole in the bottom of the housing and a coin opening in the top thereof. A removable door is received in the front of the housing and is secured thereto by a lock attached to the inside top of the vault housing.A key with key extension is received through the key hole in the bottom of the housing for unlocking the lock when opening the vault to remove the coins therefrom.

The advantages and objects of the invention will become evident from the following detailed description of the drawings when read in connection with the accompanying drawings which illustrate preferred embodiments of the invention.

DETAILED DESCRIPTION OF THE DRAWINGS

In the United States and other countries, it is a shame people will go to a great effort to steal a few dollars in coins by destroying coin boxes used in conjunction with car washes, vending machines and other coin operated equipment. Hammers, tire irons, pry bars and welding of an eye on the box and pulling with a chain using a four wheel drive are all means today for breaking into coin boxes The subject inventors being skilled in operating and maintaining equipment used with car wash operations have developed the subject invention and have been successful in substantially reducing, if not eliminating, coin box theft.

Because the strength of the coin vault is important the vault was placed under a bench test for tension where it exceeded 24,000 psi before failure and exceeded 94,000 psi before failure under compression.

Figure 1:
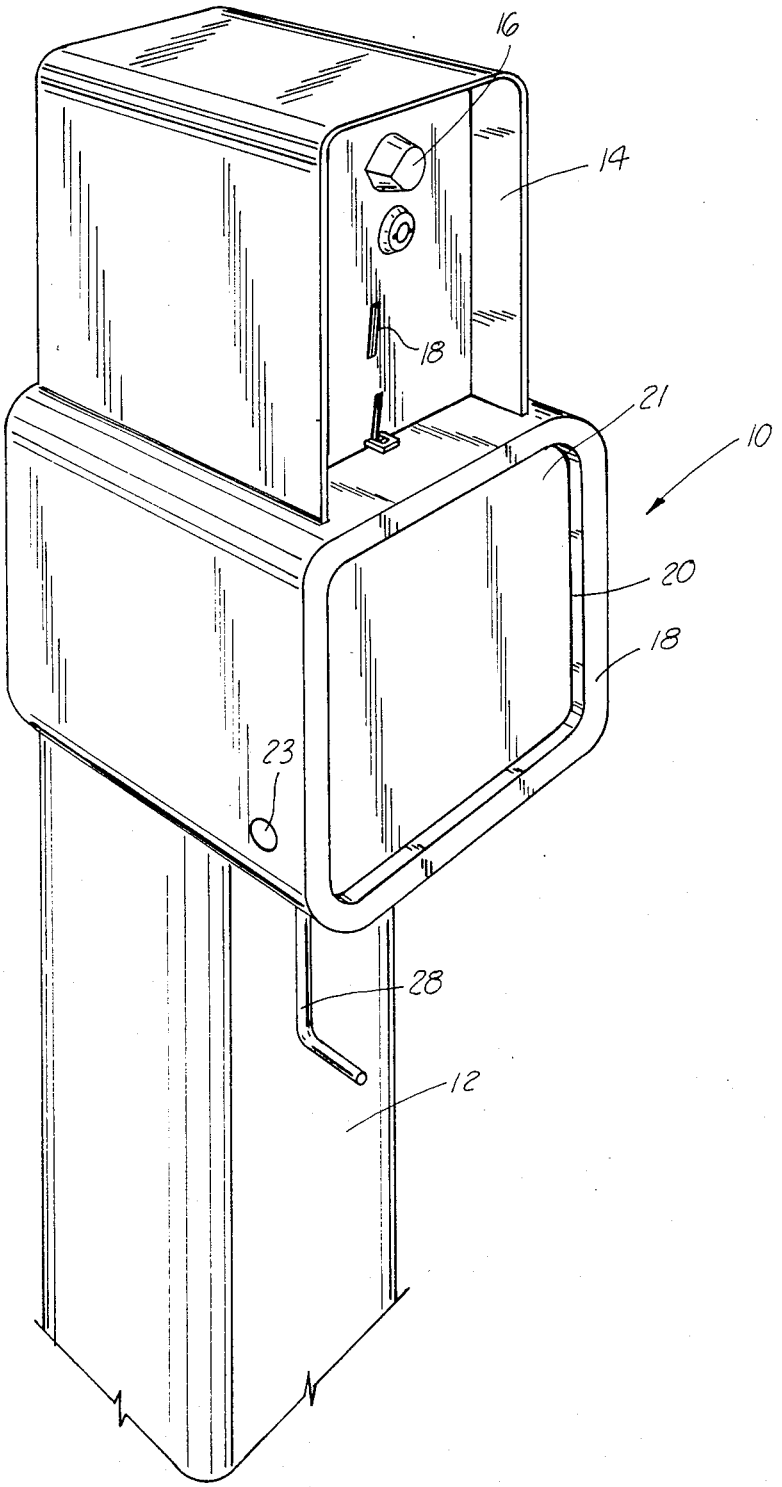
FIG. 1 is a perspective view of the coin vault mounted underneath a standard car wash coin and switch box with the coin vault mounted on top of a vertical post.

In FIG. 1 the coin vault is designated by general reference numeral 10. The coin vault 10 is mounted on top of a vertical post 12 and disposed under a standard car wash coin and switch box 14 having a standard "on/off", wash and rinse cycle switch 16 with a coin slot 18 for receiving coins.

Figure 2:
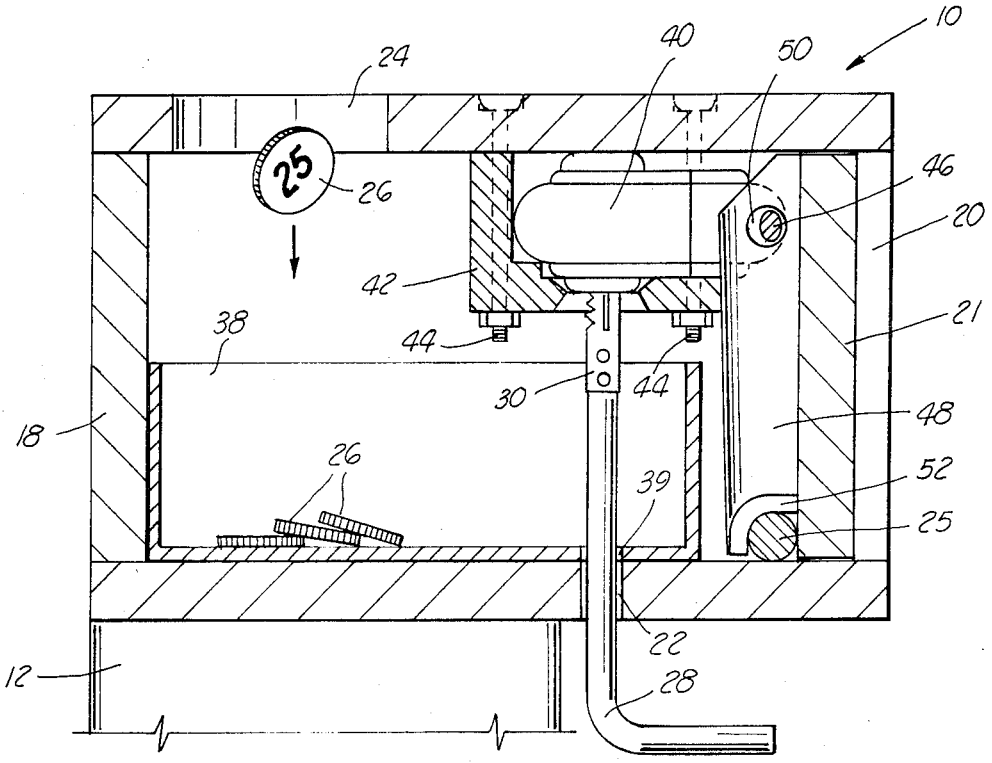
FIG. 2 is a side sectional view of the coin vault.

The coin vault 10 includes an enclosed housing 18 having an open front 20, a key hole 22 in the bottom of the housing 18 and a coin opening 24 in the top thereof as shown in FIG. 2 for receiving, by gravity feed, coins 26 received from the car wash coin and switch box 14.

The enclosed housing 18 receives in the open front 20 a removable door 21 which is offset from the front of the housing 18 from one-quarter to one-half inch to prevent someone from using a pry bar, tire iron or the like from engaging the removable door 21 and removing it from the housing 18. Drilled into the sides of the housing 18 and adajacent the rear of the door 21 are a pair of bore holes 23 used for receiving a one-half inch hinge rod 25 which can be seen more clearly in FIGS. 2 and 3. The hinge rod 25 is then welded inside the bore holes 23 and secured thereto.

Figure 3:
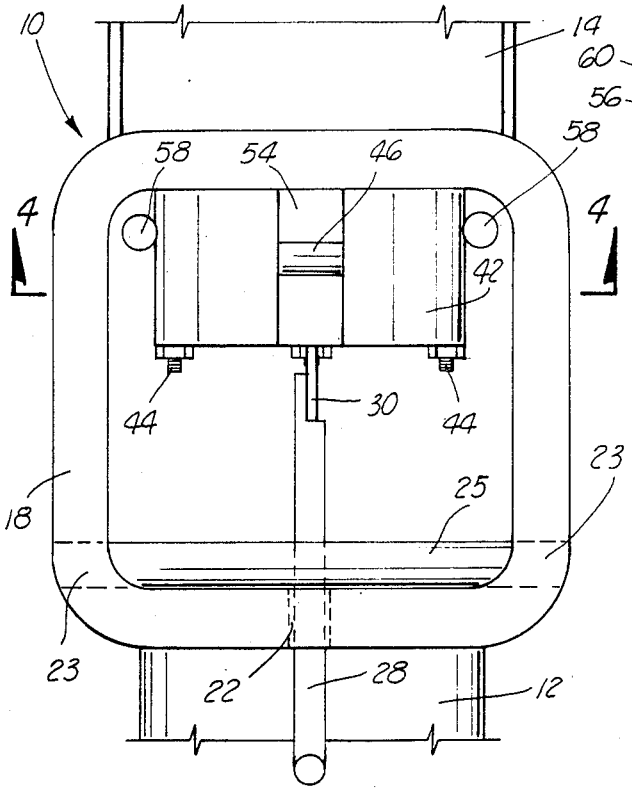
FIG. 3 is a front view of the vault with the door removed.

Seen extending from the bottom of the housing 18 is a key extension 28 having a key 30 attached thereto. A portion of the key extension 28 and key 30 are received through the key hole 22 as shown in FIGS. 2 and 3. The key hole 22 acts not only for receiving the key 30 and extension 28 but also acts as a drain should any moisture be received inside the vault 10. By placing the key extension 28 adjacent the post 12 within a range of one-eighth to one-quarter inch, a person is discouraged from using a heavy duty drill and enlarging the hole 22 since the drill chuck would be unable to be positioned adjacent the hole 22 without hitting against the side of the post 12.

From reviewing FIG. 1 it can be seen that the coin vault 10 is streamlined in appearance and to the outside observer there is no apparent means to gain entrance therein. In FIG. 2 a side sectional view of the coin vault 10 is shown. In this view, the coin opening 24 can be seen in the top of the housing 20 for the gravity feed of the coins 26 from the car wash coin switch box 14. The coins 26 are received in a removable coin tray 38 which is used to collect the coins and provide easy removal when the vault 10 is opened. It should be noted the tray 38 can also include a tray hole 39 therein for receiving the key 30 and extension 28 therethrough.

The vault 10 further includes a disk lock 40 surrounded by a lock casing 42 which is used to surround and secure the disk lock 40 to the top of the housing 18 using casing bolts 44. The disk lock 40 includes a lock hasp 46 which engages a vertical brace 48 welded to the rear of the removable door 21. The hasp 46 is received through a brace hole 50 in the top of the brace 48. Secured to the bottom and the rear of the removable door 21 is a "L" shaped hinge 52 which extends along the width of the door 21 and is received around the hinge rod 25 when the door 21 is in a closed locked position.

In FIG. 3 a front view of the coin vault 10 is shown with the door 21 removed. Also, in this view, the key 30 is shown engaging the disk lock 40 for opening the lock hasp 46 to remove the door 22. The lock casing 42 includes a casing opening 54 in the front thereof and having a width approximately the same as the exposed length of the lock hasp 46. By surrounding the disk lock 40 with the casing 42 and providing the opening 54, the strength of lock 40 is greatly improved to the point where normally it would take approximately 2,000 psi in tension to break the hasp 46 from the lock 40. By surrounding the lock 40 with the casing 42, the hasp 46 must be sheared away from the lock 40. When the hasp 46 is placed in shear it takes in excess of 24,000 psi to shear the hasp away from the housing of the lock 40.

Figure 4:
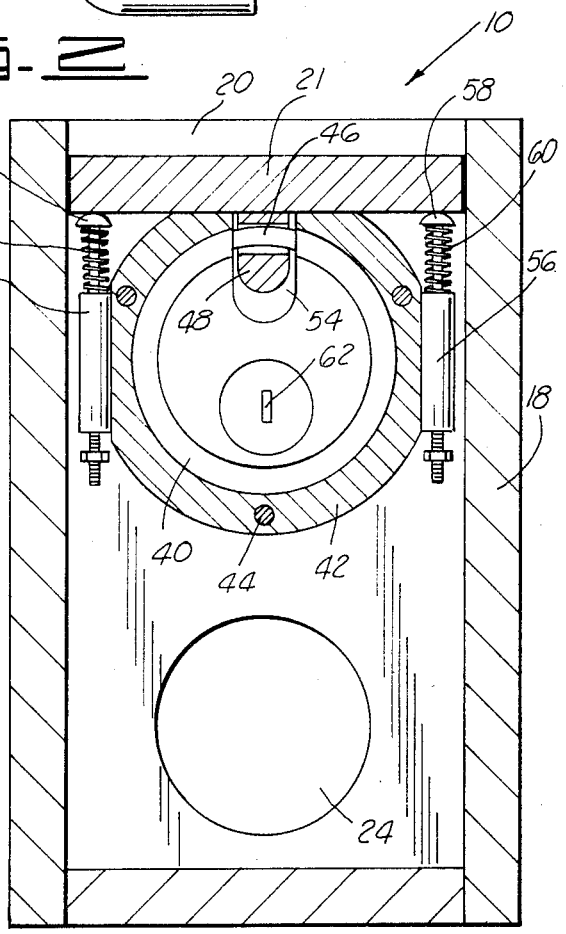
FIG. 4 is a top sectional view taken along lines 4—4 shown in FIG. 3.

In FIG. 4 a top sectional view taken along line 4—4 shown in FIG. 3 is shown. In this FIG. a pair of sleeves 56 can be seen attached to the sides of the casing 42 for receiving a pair of slide bolts 58. Slide bolts 58 are biased against the rear of the removable door 21 by a pair of coil springs 60. In operation, the coin vault 10 is opened by inserting the key 30 with key extension 28 through the key hole 22. The key 30 is received through the coin tray 38 and then inserted into a disk lock key opening 62. The lock 40 is then opened with the hasp 46 disengaging the removable door 21. At this time, the slide bolts 58 urge the door 21 outwardly from the front 20 of the housing 18 with the door 21 rotating on the hinge rod 25. The door 21 is then removed along with the coin tray 38. When the tray 38 has been emptied and placed again inside the housing 18, the key 30 is again inserted into the lock 40 and at the same time the door 22 is received on top of the hinge rod 26 with the top of the door 22 compressing the slide bolts 58 inwardly until the lock hasp 46 is received again through the brace hole 50 and securing the removable door 21 in a locked position.

It should be noted that all of the removable parts of the vault 20 are conveniently mounted at the top of the housing 18 to prevent moisture from accumulating near these parts and also to be adjacent the heated car wash coin and switch box 14.

While the coin vault 10 has been described as above being used in conjunction with a standard car wash coin and switch box 14 and mounted on top of a vertical post 12, it should be appreciated that this unique vault can be used equally well with various types of coin receiving devices to prevent the theft of coins.

Changes may be made in the construction and arrangement of the parts or elements of the embodiments as described herein without departing from the spirit or scope of the invention defined in the following claims.

What is claimed is:

1. A coin vault adapted for receiving coins from a coin operated device, the vault comprising:

an enclosed vault housing an open front, a key hole in the bottom of the housing and a coin opening in the top thereof;

a removable door including a vertical brace mounted on the rear thereof, received in the front of the housing and releaseably hinged to the housing;

a disk lock with a lock hasp, the lock surrounded by a lock casing having a key hole and a casing opening indexed with the lock hasp, the casing opening approximately the width of the exposed length of the lock hasp, the casing and lock secured to the inside top of the housing, the hasp engaging the brace portion of the door when it is received through the casing opening and the door is in a locked position; and a key with key extension, the key and a portion of the key extension received through the key holes for unlocking the lock when opening the vault to remove the coins therefrom.

2. The coin vault as described in claim 1 further including biasing means attached to the inside of the housing and engaging the removable door, the biasing means urging the door outwardly from the housing when the door is unlocked.

3. The coin vault as described in claim 1 further including at least one slide bolt with coil spring therearound attached to the inside of the housing, the spring biasing the bolt against the door and urging the door outwardly from the housing when the door is unlocked.

4. The coin vault as described in claim 1 further including a removable coin tray received inside the housing and disposed below the coin opening for receiving and collecting coins as they are dropped therein.

5. A coin vault adapted for receiving coins from a coin operated device, the vault comprising:

an enclosed vault housing having an open front, a key hole in the bottom of the housing, a coin opening in the top thereof, and a hinge rod secured to the bottom of the housing;

a removable door including a vertical brace mounted on the rear thereof, received in front of the housing and releasably hinged to the hinge rod in the housing;

a disk lock with lock hasp, the lock surrounded by a lock casing having a key hole and a casing opening indexed with the lock hasp, the casing opening approximately the width of the exposed length of the lock hasp, the casing and lock secured to the inside top of the housing, the hasp engaging the brace portion of the door when it is received through the casing opening and the door is in a locked position;

a pair of sleeves attached to the opposite side of the lock casing;

a pair of slide bolts received in the sleeves and having coil springs therearound, the springs biasing the slide bolts against the door for urging the door outwardly from the housing when the door is locked; and a key with key extension, the key and a portion of the key extension received through the key holes for unlocking the lock when opening the vault to remove the coins therefrom.

* * * * *